United States Patent [19]

Prather et al.

[11] Patent Number: 4,941,497

[45] Date of Patent: Jul. 17, 1990

[54] WALKER

[76] Inventors: William R. Prather, 1433 Beacon St., #709, Brookline, Mass. 02146; Warren Wong, 3231 Allan Pl.; Palmer Hafdahl, 21 Craigside Pl. #8D, both of Honolulu, Hi. 96817

[21] Appl. No.: 320,661

[22] Filed: Mar. 8, 1989

[51] Int. Cl.[5] ..... A61H 3/00

[52] U.S. Cl. ..... 135/67; 135/71; 135/84; 272/119; 272/134; 272/144; 2/44

[58] Field of Search ..... 135/67, 71, 84, 66, 135/76; 297/5, 6; 272/119, 134, 143, 144; 280/87.05, 87.01; 2/44, 45

[56] References Cited

U.S. PATENT DOCUMENTS

| | | | |
|---|---|---|---|
| 1,307,058 | 6/1919 | McGrath | 135/67 X |
| 2,109,188 | 2/1938 | Bajanova | 2/44 X |
| 2,792,052 | 5/1957 | Johannesen | 135/67 |
| 3,570,011 | 3/1971 | Naig | 2/44 |
| 3,778,052 | 12/1973 | Andow et al. | 135/67 X |
| 4,342,465 | 8/1982 | Stillings | 135/67 X |
| 4,621,804 | 11/1986 | Mueller | 135/67 X |
| 4,770,410 | 9/1988 | Brown | 135/67 X |
| 4,787,101 | 11/1988 | Feinberg | 2/114 X |

FOREIGN PATENT DOCUMENTS

| | | | |
|---|---|---|---|
| 123814 | 3/1919 | United Kingdom | 135/71 |

OTHER PUBLICATIONS

Copy of advertisement by J. A. Preston Corporation showing a plurality of specialty walkers.

*Primary Examiner*—David A. Scherbel
*Assistant Examiner*—Lan Mai
*Attorney, Agent, or Firm*—Barry R. Lipsitz

[57] ABSTRACT

A walker is disclosed to provide support for a person who would otherwise have great difficulty in moving around in a hospital or home setting. The walker includes a frame having pivotable wheels to enable movement of the frame. Support structure is suspended from the frame for holding the person. The support structure includes a seat on which the person can sit and a torso device for supporting the upper torso of the person.

16 Claims, 3 Drawing Sheets

WALKER

BACKGROUND OF THE INVENTION

While the invention is subject to a wide range of applications, it is particularly suited for enabling a dysfunctional patient to move about in a hospital or nursing home facility. In particular, a walker is disclosed including structure to support both the seat and torso of the person using the walker.

In the past, certain dysfunctional patients such as elderly persons in a hospital facility such as a geriatric ward, were unable to move about the facility without the help of an attendant. Still, these elderly patients require exercise in muscles of their lower extremities to keep their muscles toned and to prevent their muscles from becoming stiff. If such a dysfunctional patient were to attempt to move through the facility by themselves, they could injure themselves in a number of ways such as losing their balance and falling. For an elderly patient, a fall could result in a serious injury.

It has been known for small children to use walkers with wheels to propel themselves about using their legs and feet prior to developing the ability to walk independently. These child walkers are typically a frame with a seat having wheels attached thereto. The child is placed in the walker and supported by the seat. However, these walkers do not support the upper torso of the child.

Further, specialty walkers have been used for therapeutic reasons such as assisting a child having severe muscle or bone weakness in maintaining their walking.

It is an object of the present invention to provide a walker which overcomes some of the problems and shortcomings of the prior art, including those mentioned above.

It is another object of the present invention to provide a walker to enable a dysfunctional person to independently propel themselves through a hospital facility.

It is another object of the present invention to provide a walker which provides easy entry and exit for a dysfunctional person.

It is a still further object of the present invention to provide a walker which supports both the seat and upper torso of a person.

It is a yet further object of the present invention to provide a walker having a frame which is adjustable to accommodate persons of different sizes.

It is a still further object of the present invention to provide a walker which is relatively inexpensive to manufacture.

These and other important objects will be apparent from the descriptions of this invention which follow.

SUMMARY OF THE INVENTION

Accordingly, there has been provided a walker to provide support for a person who would otherwise have great difficultly in moving around in a hospital or home setting. The walker includes a frame having at least three pivotable wheels attached to enable movement of the frame. Support structure is suspended from the frame for securely holding the person. The support structure includes a seat on which the person can sit and a torso device for supporting the upper torso of the person.

BRIEF DESCRIPTION OF THE DRAWINGS

The invention and further developments of the invention are now elucidated by means of preferred embodiments shown in the drawings.

DETAILED DESCRIPTION OF THE PREFERRED EMBODIMENT

Figure 1:
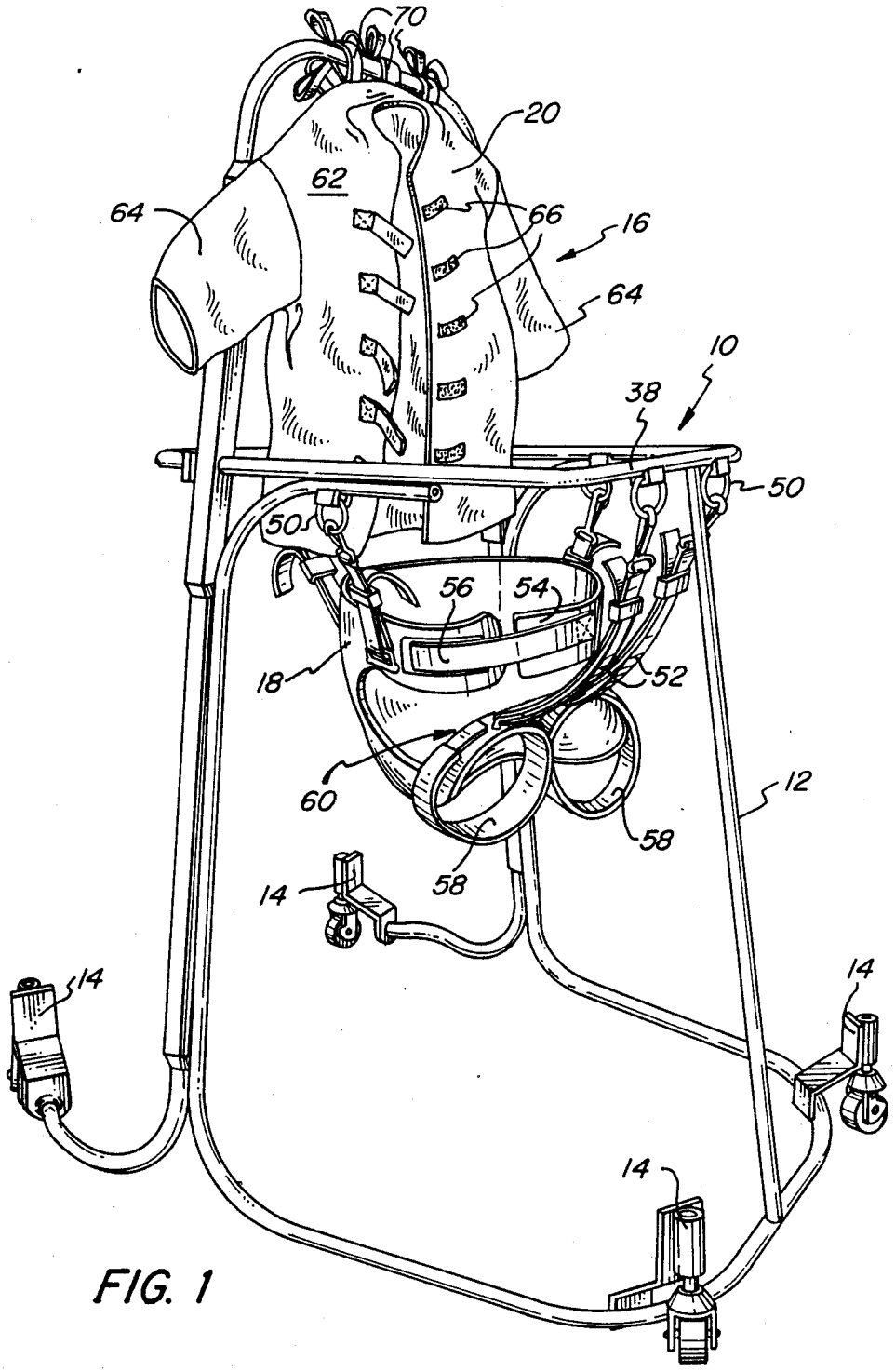
FIG. 1 is a perspective view of the walker including the seat and torso support structures in accordance with the present invention.

Referring to FIG. 1, there is shown a walker 10 which is adapted for use with dysfunctional patients that require support in order to move about. The walker 10 includes a frame 12 having at least three pivotable wheels 14 attached thereto to enable movement of the frame 12. Support structure 16 is suspended from the frame 12 for holding a person. The support structure includes a seat component 18 for a person to sit on and a torso component 20 for supporting the upper torso of a person using the walker 10.

Figure 2:
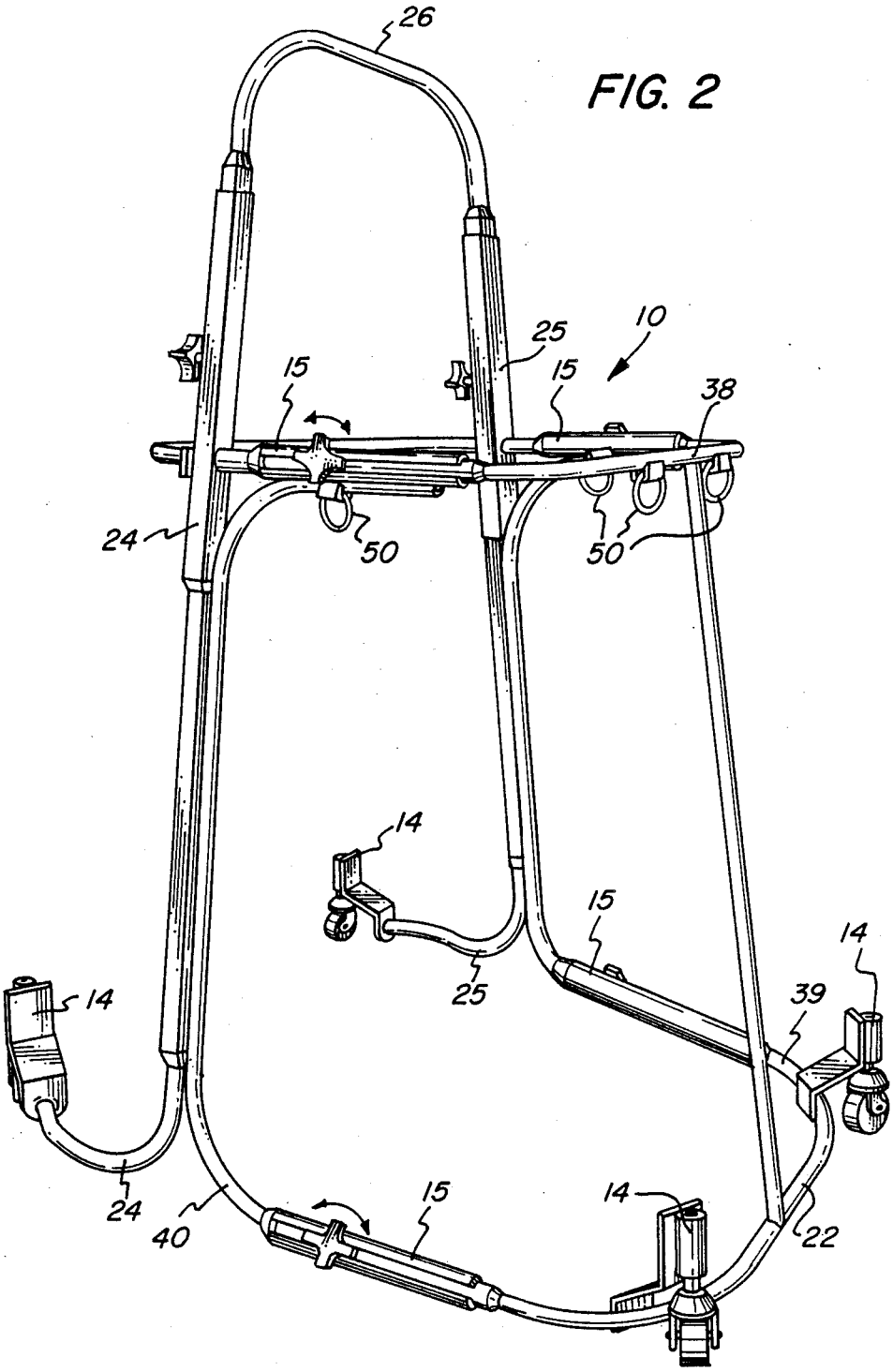
FIG. 2 is a perspective view of the frame of a walker in accordance with the present invention.

Referring to FIG. 2, a detailed drawing of the frame 10 is provided. The frame can be attached to four pivotable wheels 14 to enable freedom of the frame to freely move about. Although all of the wheels 14 illustrated are pivotable, it is within the terms of the invention for either the front pair of wheels attached to the bottom support tube 22 of frame 10 or the pair of wheels attached to the outer ends of tubes 24 and 25 to be fixed and not pivotable. Also, the frame can be supported by three, five or more wheels.

An important aspect of the present invention relates to the adjustability of the frame so that it can accommodate people of different sizes. The upstanding portion of the frame incorporating tubes 24 and 25 includes an upper curved frame element 26 whose ends 28 and 30 are adjustably disposed within slots 32 and 34 of the tubes 24 and 25, respectively. Handles 36 secure ends 28 and 30, by any conventional means, within the slots 32 and 34 in any desired location. The provision of the handles or any other similar mechanism enables the tube 26 to be adjusted in a vertical direction as illustrated by arrow 35 in FIG. 3.

Frame 10 also includes a stability bar 38 which projects outwardly from the front portion of the frame and provides a structural component for a person to hold and balance himself or herself while moving about in the walker. The stability bar 38 can also be adjustable , as shown in the embodiment of FIG. 2, to enable the distance which it projects outward from the tubes 24 and 25 to be adjusted in accordance with the size of a person occupying the walker. To make the stability bar adjustable, conventional adjusting means 15 comprising slotted connectors are provided on opposing sides of the stability bar 38 as well as in the opposing sides 39 and 40 of the lower frame member 22.

Figure 3:
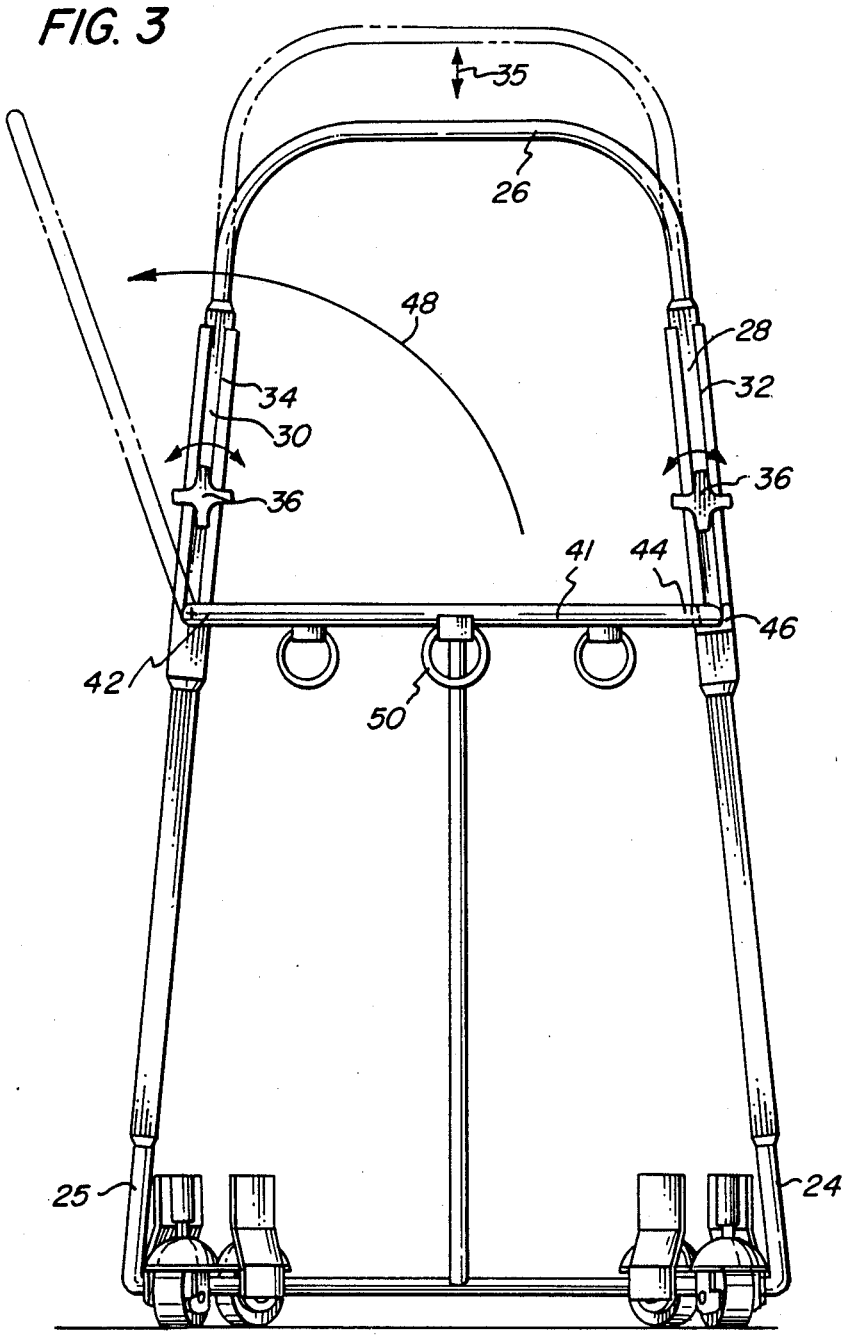
FIG. 3 is a rear view of the frame of the walker of the present invention.

The frame 10 further includes a gate element 41, see FIG. 3, which has one end 42 pivotably connected to the tube 25 and a second end 44 adapted to be received in a notched frame element 46 attached to tube 24. The gate element 41 pivots upwardly as illustrated by arrow 48 so that a person can enter the frame and be placed within the support structure 16 as described hereinafter. Once the person is secured within the frame, the gate element 41 is pivoted back to the position shown in FIG. 3 with the end 44 supported in the notched frame element 46.

The seat structure 18 is suspended from the stability bar 38 as shown in FIG. 1. A plurality of ring elements 50 are attached to the stability bar by any conventional means as illustrated. The seat is hung from the rings 50 by adjustable straps 52. The adjustable straps 52 enable the height of the seat to be adjusted as required for the specific patients. The seat can include an adjustable waistband 54 which can be opened and closed by any desired means such as a velcro closure strap 56. Also, legbands 58 are provided on the seat to provide means to securely support the patient within the seat. The legbands 58 can be adjusted and secured by the velcro closures 60. Although velcro closures are illustrated due to the ease in which they can be closed or opened, it is within the terms of the present invention to substitute any conventional closure for adjusting the size of the waistband or legbands.

An important aspect of the present invention relates to the torso component 20 which supports the upper body of a patient using the walker 10. As illustrated in FIG. 1, the torso element 20 can be a jacket-like garment 62 having arms 64 and closures 66. The torso component 20 can be attached to the top structure 26 by any desired means such as straps 70. Although a jacket-like garment is illustrated, it is within the terms of the present invention to use any device to support the person's torso, such as a jacket without sleeves, a vest-like garment or a harness.

In using the walker 10, the height of the top element 26 is first adjusted so that the torso component 20 is positioned at an appropriate height corresponding to the size of the person using the walker. Also, the height of seat structure 18 is adjusted with straps 52 so that the person's feet can reach the floor. Next, the gate element 41 is pivoted open to allow easy entry of the person into the walker. To put a person on the walker, the seat 18 is first disconnected from the frame with the snaphooks normally attached to hooks 50. Then, the seat can be put onto the person while they are in bed or supported by an attendant. The seat 18, with the person therein, can then be reattached to the frame with the snaphooks on the straps 52. If necessary, the attendant can adjust the waistband and legbands 58 to comfortably hold the person in place. Typically, attendants help the person put on the torso support 20 and secure it into place with the closures 66. Next, the gate element is returned to the closed position, i.e. end 44 received in notched frame element 46, and a strap from seat 18 is attached to the ring 50 connected to the gate element 41. The person is now fully supported by the seat and torso structure and is able to move about in the walker by walking and holding onto the stability bar 38 as required.

Although the adjustable straps 52 are preferably of a fixed length once they are adjusted, it is within the scope of the present invention to substitute an elastic strap or spring device to provide more give in the support structure. Spring devices for attaching the seat to the frame are particularly advantageous in that they enable the person to bounce up and down to keep the muscles toned and prevent the joints from becoming stiff. Also, the bouncing motion increases the range of motion in the lower extremities, i.e. primarily the hips, knees and ankles. The springs can also serve as a safety measure which enables the support structure to absorb any shocks in the event that the walker collides with some object.

Although the walker is primarly used for standing and walking, it also enables a dysfunctional person to rest while sitting.

Although the walker is primarily intended for use in a nursing facility or rehabilitation center, it can also be used in a home setting.

It is apparent that there has been provided in accordance with this invention a walker which satisfies the objects, means, and advantages set forth hereinabove. While the invention has been described in combination with the embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A walker, comprising:
an adjustable frame;
a stability bar affixed to and projecting outwardly from said frame for a person to hold while walking, wherein said stability bar is adjustable to enable the distance which it projects outward from the frame to be adjusted in accordance with the size of a person using the walker;
means attached to said frame for enabling movement of the frame;
support means suspended from the frame for holding a person, said support means comprising:
seat means removably attached to the frame for placement on a person prior to attachment to the frame; and
torso means comprising a garment suspended from said frame, for supporting the upper torso of a person.

2. A walker in accordance with claim 1 wherein the adjustable frame includes means to change the height of the frame.

3. A walker in accordance with claim 1 further including gate means removably connected to said frame to open and enable a person to be placed in the support means.

4. A walker in accordance with claim 3 wherein the gate means projects outward from said frame.

5. A walker in accordance with claim 4 wherein said gate means comprises a gate element having a first end pivotably connected to the frame; and
a second end supported by the frame.

6. A walker in accordance with claim 4 wherein the seat means comprises a seat attached to the stability bar.

7. A walker in accordance with claim 6 further including a frame support element adjustably supported by said frame and extending outward from the top of said upright frame for attaching the torso means.

8. A walker in accordance with claim 7 further including strap means for attaching said seat means and said torso means to said frame.

9. A walker in accordance with claim 7 further including elastic means for attaching said seat means to said frame.

10. A walker in accordance with claim 9 wherein said elastic means comprises springs.

11. A walker in accordance with claim 1 wherein the means for enabling movement comprises wheels attached to the frame.

12. A walker in accordance with claim 11 wherein said wheels are pivotably attached to the frame.

13. A walker in accordance with claim 1 further comprising legbands attached to said seat means for securely supporting a person within the seat means.

14. A walker in accordance with claim 18 further comprising means for adjusting said legbands to snugly secure a person's legs.

15. A walker, comprising:

a frame;

means attached to said frame for enabling movement of the frame;

support means suspended from the frame for holding a person, said support means comprising:

seat means removably attached to the frame for placement on a person prior to attachment to the frame; and torso means comprising a jacket suspended from said frame, for supporting the upper torso of a person.

16. A walker, comprising:

a frame;

means attached to said frame for enabling movement of the frame;

support means suspended from the frame for holding a person, said support means comprising:

seat means removably attached to the frame for placement on a person prior to attachment to the frame; and torso means comprising a vest suspended from said frame, for supporting the upper torso of a person.

* * * * *